US005676296A

United States Patent [19]

Masters

[11] Patent Number: 5,676,296

[45] Date of Patent: Oct. 14, 1997

[54] BEACH LUGGAGE

[76] Inventor: Edward Earl Masters, 8340 Chagrin Rd., Chagrin Falls, Ohio 44023

[21] Appl. No.: 682,155

[22] Filed: Jul. 17, 1996

[51] Int. Cl.[6] ..... A45F 3/04

[52] U.S. Cl. ..... 224/653; 224/651; 224/148.7; 224/630; 224/645; 383/117

[58] Field of Search ..... 224/148.7, 155, 224/582, 627, 628, 629, 630, 645, 650, 651, 652, 653, 654, 657, 153; 190/111, 112, 124, 125, 127; 62/457.1, 457.4, 457.5; 383/117, 38

[56] References Cited

U.S. PATENT DOCUMENTS

| | | | |
|---|---|---|---|
| 3,321,120 | 5/1967 | Cunningham | 224/653 |
| 4,580,667 | 4/1986 | Herwood | 383/117 |
| 4,673,117 | 6/1987 | Calton | 224/629 |
| 4,979,833 | 12/1990 | Cook | 383/117 |
| 5,004,134 | 4/1991 | Barry | 224/650 |
| 5,160,001 | 11/1992 | Marceau | 190/127 |
| 5,288,150 | 2/1994 | Bearman | 383/117 |
| 5,413,199 | 5/1995 | Clement | 383/117 |
| 5,494,157 | 2/1996 | Golenz et al. | 224/652 |
| 5,573,166 | 11/1996 | Leja | 224/630 |

FOREIGN PATENT DOCUMENTS

| | | | |
|---|---|---|---|
| 1124525 | 10/1956 | France | 190/111 |

*Primary Examiner*—Henry J. Recla
*Assistant Examiner*—Gregory M. Vidovich
*Attorney, Agent, or Firm*—Young & Basile, P.C.

[57] ABSTRACT

An article of beach luggage in the form of a substantially rectangular envelope of open mesh material subdivided into two interior portions by means of a rigid structural interior divider. The left and right portions are accessible by parallel zippers which extend around three sides of the article. One interior side is open to receive beach towels, clothing and the like, while the other side is prepacked with a cooler which, along with other types of beverage carriers, may be permanently or removably mounted on the interior divider. Chair straps, umbrella sleeves, shoulder straps, a carry handle, and feet are provided.

8 Claims, 2 Drawing Sheets

BEACH LUGGAGE

INTRODUCTION

This invention relates to beach luggage and more particularly to an article of beach luggage which is adapted and constructed to provide a convenient carrier for numerous different types of beach equipment.

BACKGROUND OF THE INVENTION

A summer trip to the beach or pool typically involves organizing and transporting various articles such as towels, chairs, umbrellas and coolers, none of which is particularly well-suited for integration with or connection to the other articles to simplify and facilitate transportation thereof. The result is often several trips between car and beach, carrying some of the equipment desired or needed for the visit on each trip.

SUMMARY OF THE INVENTION

The present invention provides an article of beach luggage which is adapted to simplify and facilitate the problem of transporting various types of beach use articles to the beach and particularly to facilitate carrying virtually all beach related articles in a single package which is easily assembled and disassembled.

In general this is accomplished by means of an article of beach luggage in the form of a substantially rectangular envelope of open mesh material having a substantial interior volume, the open mesh material being such as to easily pass and discharge the sand which inevitably collects within an enclosed container taken to the beach. Within the envelope in fixed association thereto is a substantially solid divider panel mounted mediate and parallel to the front and rear mesh panels so as to divide the interior volume into left and right portions and to provide a structure on which a cooler and/or other accessories can be mounted within one of the two interior portions of the mesh envelope. Access to the interior of the mesh envelope is provided by two parallel zippers which extend continuously around the side and top panels of the envelope, one of the zippers being located substantially immediately adjacent one side of the divider so as to provide a relatively large volume for receiving and transporting beach towels and other articles such as clothing. The other of the two zippers is mounted on the other side of but in spaced relation to the panel so as to provide access to the divider mounted cooler and such other articles or implements as may be mounted on the divider in this opposite interior volume portion. A set of straps or the like is mounted on the exterior of one of the front and rear panels to receive and transport one or more flat folded beach chairs.

In the preferred embodiment, the article of luggage is also provided with one or more umbrella sleeves which are mounted on one or both side panels between the zippers. The article of luggage is also preferably provided with shoulder straps on the major exterior panel opposite the chair straps and may further be provided with a carrying handle on the top panel and feet on the bottom panel to reduce or eliminate wear in normal usage and handling.

DETAILED DESCRIPTION OF THE ILLUSTRATIVE EMBODIMENT

Figure 1:
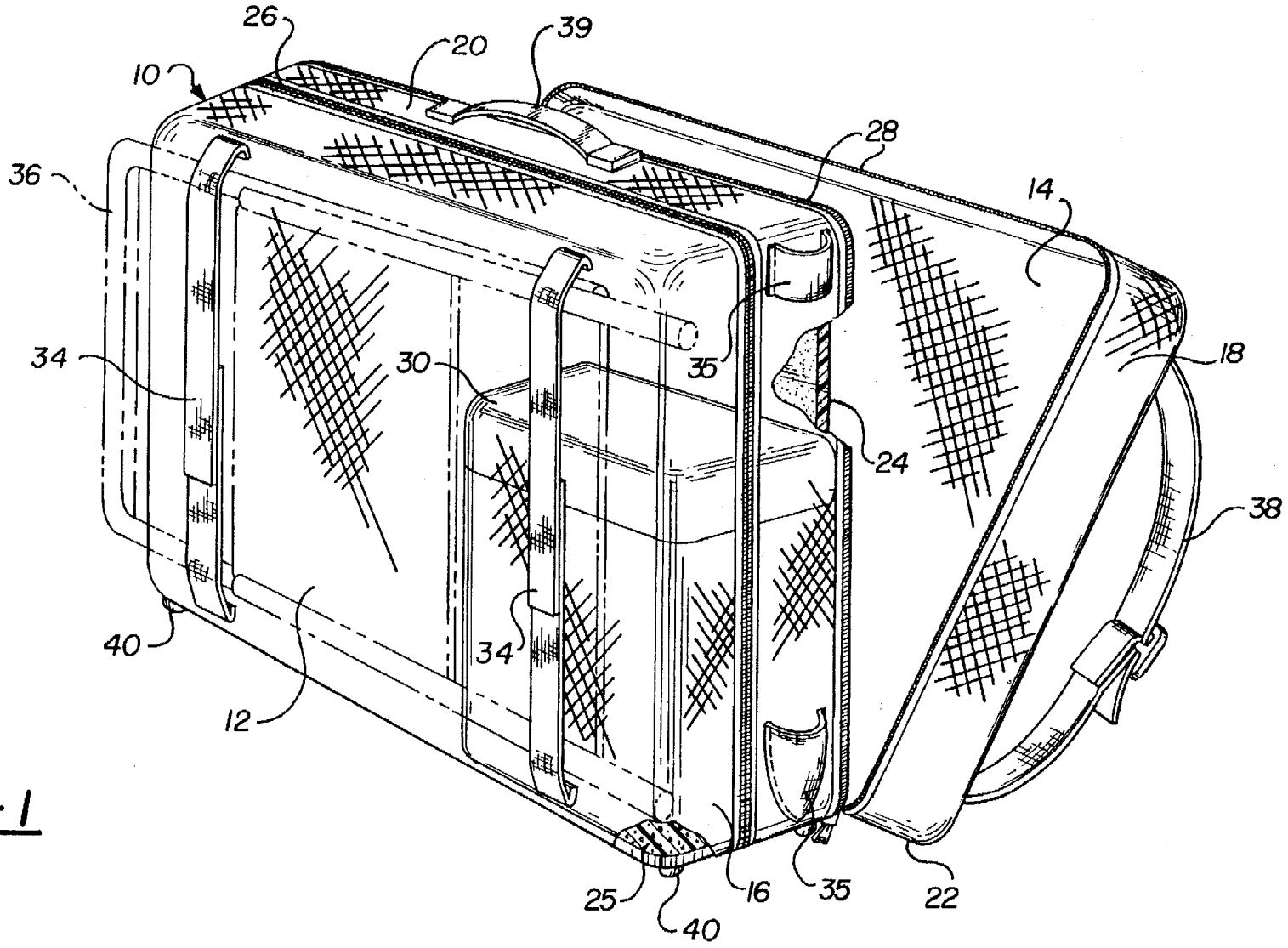
FIG. 1 is a perspective drawing of an article of beach luggage constructed in accordance with the invention.
Figure 3:
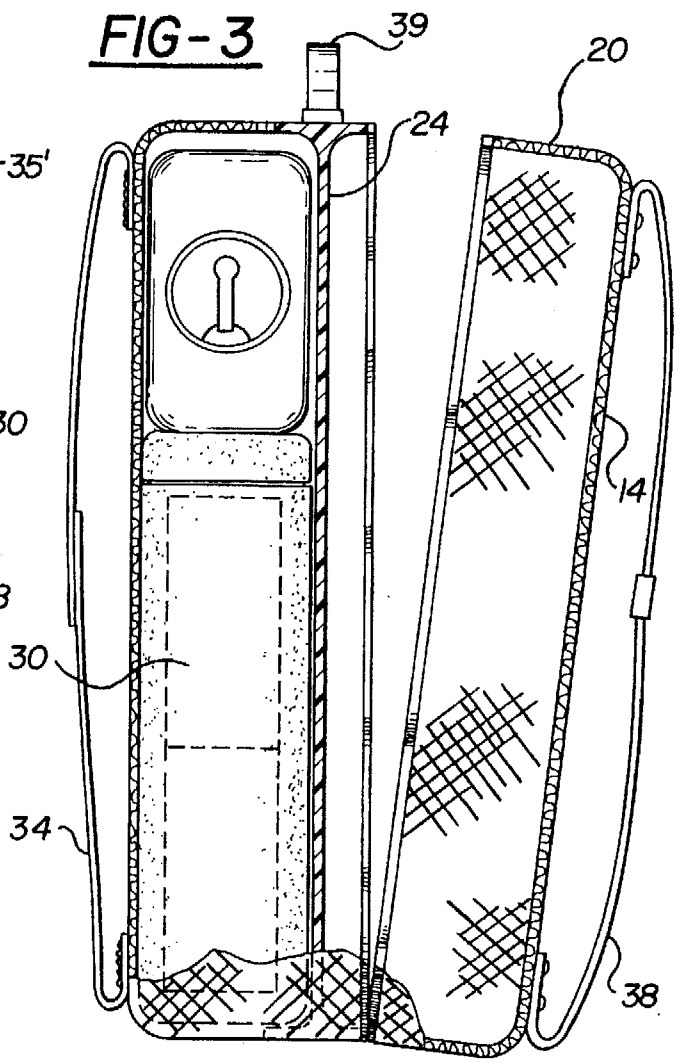
FIG. 3 is an end view of the article of FIG. 1.

Referring to the drawing there is shown an article 10 of beach luggage resembling a small suitcase and comprising a substantially rectangular envelope of open mesh material such as nylon or other suitable durable and abrasion resistant plastic, the openings of which are of such size to readily permit air and typical beach sand to pass through them. The envelope consists of parallel major front and rear panels 12 and 14, respectively, opposite side panels 16 and 18, a top panel 20 and a bottom panel 22. The panels may be suitably joined together by taping, bonding and stitching as will be apparent to those skilled in the luggage construction art. Disposed within the interior volume of the rectangular envelope 10 is an essentially solid rigid plastic divider panel 24 which subdivides the entire interior volume into left and right portions. The divider panel 24, in addition to a stiffening panel 25 which may be optionally mounted on the interior or exterior of the bottom panel 22, is a major structural and shape retaining component of the article 10 and is of such size and shape as to conform to and define the rectangular plan or outline of the article 10 as shown in the drawing. Panel 24 is fixed to and within the envelope along at least two opposite edges and preferably around the entire periphery thereof so as to maintain and occupy a fixed position relative to and between the front and rear panels 12 and 14.

A first zipper 26 is mounted within the side and top panels of the envelope 10 so as to extend continuously around three sides of the envelope to provide access to the left interior portion of the envelope as shown in the drawing. The zipper 26 is preferably located approximately half way between the divider panel 24 and the front panel 12. A second zipper 28 also extends around three sides of the envelope 10; i.e., the side and top panels, but is located substantially immediately adjacent the divider panel 24 so as to provide access to the interior volume of the article which is disposed between the panel 24 and the back or rear panel 14. This volume is especially suitable for receiving folded beach towels, clothing, and other small articles such as a camera or a small pair of binoculars.

A cooler 30 is mounted on the fixed panel 24 in the interior portion between the front panel 12 and the divider panel 24 and is of such size and shape as to be suitable for receiving approximately six 12 oz beverage cans and a quantity of ice. The cooler illustrated in the drawing is on the order of 8×6×12 inches in size and may be of either rigid or non-rigid construction; a suitable product is manufactured by the Porter Company. The panel 24 may also be provided with means such as straps for receiving and holding a number of beverage bottles 42 similar to those available in sports stores. Velcro strap-type fasteners or the like may be used for this purpose. Alternatively, the balance of the interior volume of the left portion of the mesh envelope 10 may be left open for selected use by the owner.

To serve not only as an interior divider but also a structure for carrying the cooler 30 and/or other articles, the panel 24 must be essentially rigid and of adequate structural strength to receive rivets or other suitable non-corrosive fasteners. A solid polyethylene or polystyrene panel of approximately ⅛th inch thickness may be used for this purpose. Alternatively, and for the purpose of reducing the weight of the panel 24, a foam-filled, ribbed or corrugated plastic panel may also be used for this purpose.

On the exterior of the front panel 12 are mounted a pair of fabric straps 34 which are adapted to receive in folded stacked relationship one or two beach chairs 36 each of which is approximately 3.5×31×26.5 inches when folded flat. The straps are provided with suitable adjustable means such as buckles or Velcro connectors.

Figure 2:
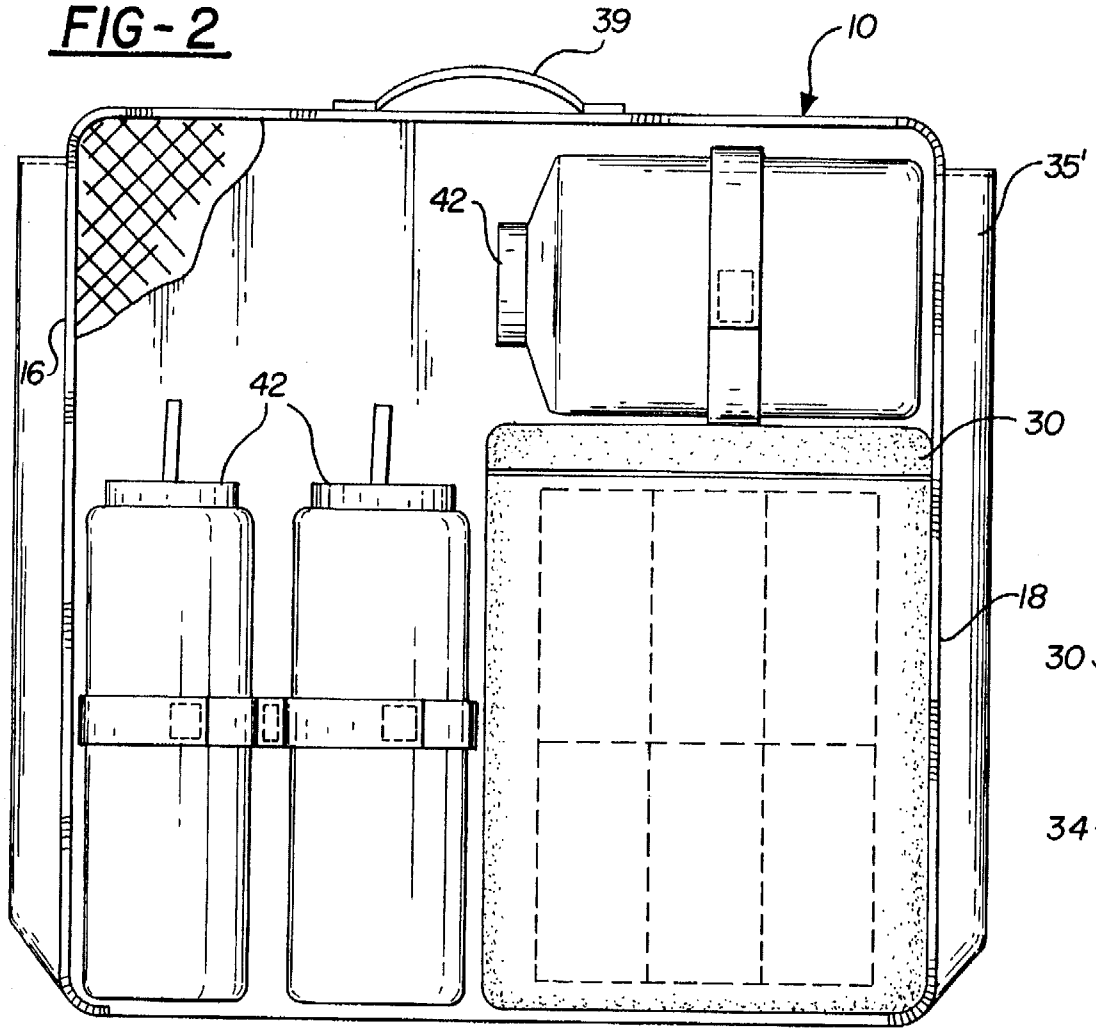
FIG. 2 is a plan view of the interior of one of the sections of the luggage article of FIG. 1.

An umbrella sleeve 35, 35' is mounted on the exterior of side panel 16 between the zippers 26 and 28 to receive a beach umbrella. A second sleeve may be mounted on the opposite side panel as desired. The sleeves may be complete as shown at 35' in FIG. 2 or segmented as shown at 35 in FIG. 1.

Shoulder straps 38 are mounted on the exterior of the rear panel 14 to permit the loaded article to be carried on one's back. When fully loaded, the article 10 may weigh as much as 20 lbs. and this provision for carrying is particularly handy. A handle 39 is mounted on the top panel 18 and feet 40 may be mounted on the bottom panel by way of the stiffener 25 to reduce wear on the bottom mesh panel.

It is to be understood that various changes and additions may be made to the beach luggage as will be apparent to those skilled in the art. For example, size and shape may change; the character and color of the nylon mesh may be changed; the color, style and fabric of the straps may be changed; adhesives may be used in place of rivets and other fasteners and so forth.

I claim:

1. An article of beach luggage comprising:

a substantially rectangular envelope of open mesh material, the openings of which are of such size to readily permit air and beach sand to pass there through, having parallel front and rear panels and peripheral side, top and bottom panels joining the front and rear panels to define an interior volume;

a substantially solid divider mounted within the interior volume in fixed parallel spaced relationship to and between the front and rear panels;

a first zipper extending continuously around and through the side and top panels immediate the divider and one of the front and rear panels for accessing one interior side of the envelope;

a second zipper extending continuously around and through the side and top panels parallel to the first zipper and substantially immediately adjacent the divider but effectively between the divider and the other of the front and rear panels for accessing another interior side of the envelope; and means mounted on the exterior of one of the front and rear panels for securing a beach chair to the envelope.

2. An article of beach luggage as defined in claim 1 wherein:

the divider is made of substantially rigid material and is of such size and shape as to subdivide the entirety of the interior volume of the envelope; and a storage container mounted on the divider within the volume which is accessed by said first zipper.

3. An article of beach luggage as defined in claim 2 wherein said container is an insulated cooler.

4. An article of beach luggage as defined in claim 1 further including sleeve means mounted on a side panel between the first and second zippers for receiving and holding a beach umbrella.

5. An article of beach luggage as defined in claim 1 further including shoulder straps mounted on the back panel.

6. An article of beach luggage as defined in claim 1 wherein said means for securing the beach chair comprises a pair of parallel straps.

7. An article of beach luggage as defined in claim 1 further including a handle mounted on the top panel between the first and second zippers.

8. An article of beach luggage as defined in claim 1 further including foot means mounted on the exterior surface of the bottom panel.

* * * * *